US005629686A

United States Patent [19]

Miyauchi

[11] Patent Number: 5,629,686

[45] Date of Patent: May 13, 1997

[54] SELECTIVE CALL RECEIVER HAVING AN OPTIONAL DISPLAY MODE

[75] Inventor: Motoya Miyauchi, Yokohama, Japan

[73] Assignee: Matsushita Electric Industrial Co., Ltd., Osaka, Japan

[21] Appl. No.: 380,441

[22] Filed: Jan. 30, 1995

Related U.S. Application Data

[63] Continuation of Ser. No. 955,407, Oct. 2, 1992, abandoned.

[30] Foreign Application Priority Data

Oct. 11, 1991 [JP] Japan ..... 3-263474

[51] Int. Cl.[6] ..... G08B 5/22

[52] U.S. Cl. ..... 340/825.44

[58] Field of Search ..... 340/825.44, 825.48, 340/311.1; 455/89; 379/57

[56] References Cited

U.S. PATENT DOCUMENTS 4,769,641 9/1988 Yoshizawa et al. ..... 340/825.44
4,818,987 4/1989 Ide et al. ..... 340/825.47
4,873,519 10/1989 Matai et al. ..... 340/825.44
5,173,688 12/1992 DeLuca et al. ..... 340/311.1
5,225,826 7/1993 DeLuca et al. ..... 340/825.44

FOREIGN PATENT DOCUMENTS 1270421 10/1989 Japan .

*Primary Examiner*—Michael Horabik
*Assistant Examiner*—Edward Merz
*Attorney, Agent, or Firm*—Watson Cole Stevens Davis, P.L.L.C.

[57] ABSTRACT

A selective call receiver adapted to display a newly received message, when it is directed to an address optionally selected under current display, without automatically resetting the display of the message. When a given switch is activated while a message assigned with the current address is displayed, a CPU is interrupted so that a timer is set to an infinite reset time. In this mode, when newly transmitted data is received, its address is compared with the address already stored in the memory of the decoder. If both the addresses are the same, the new message is displayed on the LCD. If they are different, the new address and message are stored in RAM without executing signalling operation or the display operation.

11 Claims, 2 Drawing Sheets

SELECTIVE CALL RECEIVER HAVING AN OPTIONAL DISPLAY MODE

This application is a continuation of application Ser. No. 07/955,407, filed Oct. 2, 1992 (abandoned).

BACKGROUND OF THE INVENTION

1. Field of the Invention

The present invention relates to a selective call receiver capable of receiving and displaying a message by using a radio wave.

2. Description of the Related Art

Conventional selective call receivers execute a signalling operation and display operation each time they receive a new message.

SUMMARY OF THE INVENTION

If an information service station transmits a plurality of new messages while such a conventional selective call receiver is displaying another message, then it is required to perform both the signalling operation and display operation for each new message, resulting in a number of operations. Furthermore, if a user wants to always monitor the latest message directed to a certain address, the user is forced to always search for it.

The present invention aims at solving such conventional problems and provides an improved selective call receiver capable of always displaying the latest message directed to a particular or optionally selected address.

In order to achieve the above object of the present invention, there are provided a timer clear circuit for disabling a timer by a predetermined switch operation during a message display period, and a comparator for comparing an address assigned to the displayed message with a newly received address. If both the addresses are the same, the new message is displayed, whereas if they are different, signalling operation and display operation are not carried out, but the received message is stored in a memory.

According to the present invention, if a user activates the switch in the predetermined manner, the selective call receiver can display only those messages directed to a particular address. Accordingly, only desired messages can be sequentially displayed and the latest message directed to the particular address can be monitored at all times. In this case, messages directed to different addresses are stored in the memory without performing the signalling operation and display operation. Accordingly, a user can monitor only desired messages without being interrupted by such a signalling operation. The messages stored in the memory can be displayed at any time when it becomes necessary.

DESCRIPTION OF THE PREFERRED EMBODIMENT

Figure 1:
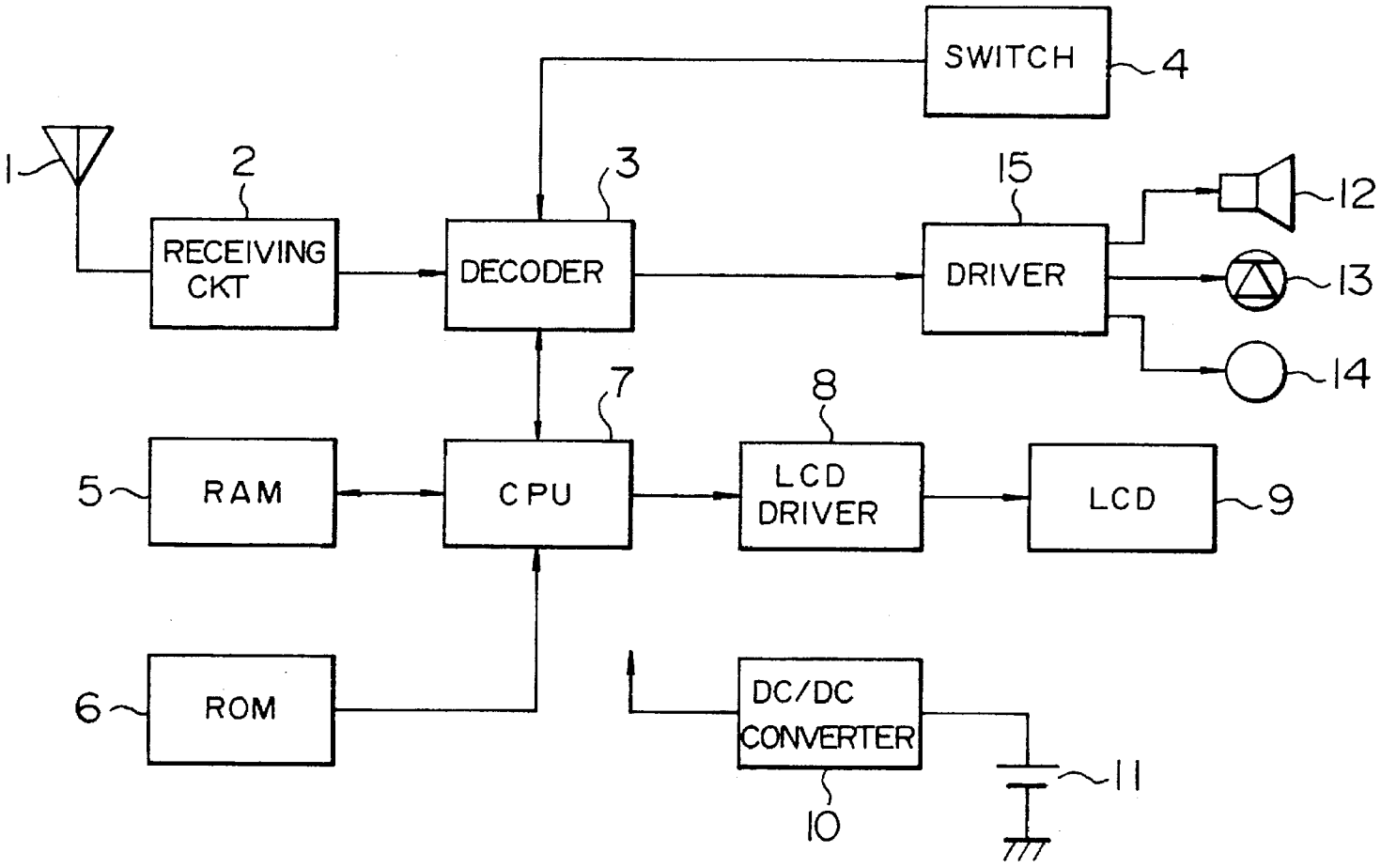
FIG. 1 is a block diagram showing the outline of an embodiment of the selective call receiver according to the present invention.

FIG. 1 shows the structure of the selective call receiver according to the embodiment of the present invention. In FIG. 1, an antenna 1 receives a radio wave signal or transmitted data which contains a frame synchronizing signal, a receiver call number, a function designating number, and a message. A receiving circuit 2 demodulates signal received by the antenna 1. A decoder circuit 3 decodes the signal demodulated by the receiving circuit 2, the decoder 3 also has a function of a comparator for comparing a proprietary call number with an incoming call number. A switch 4 is used to selectively designate one of various functions of the selective call receiver.

A random access memory (RAM) 5 stores received messages. A read-only memory (ROM) 6 stores proprietary call numbers and function designating numbers. A central processing unit (CPU) 7 controls received message data processing, signalling operation, display operation, and the like. A driver circuit 8 is controlled by CPU 7 and drives a liquid crystal display (LCD) 9 which displays a received message and the like.

A voltage booster circuit such as a DC/DC converter 10 is supplied with a d.c. voltage from a battery 11. A loudspeaker 12 signals a user by means of sounds or voices. An LED 13 signals a user by means of light. A motor 14 signals a user by means of vibrations. A driver 15 drives the loudspeaker 12, LED 13, and motor 14 which serve as signalling means.

The operation of the selective call receiver constructed as above will be described below.

A radio wave received by the antenna 1 is amplified and demodulated by the receiving circuit 2, and converted into signal having a waveform readable by the decoder 3.

The decoder 3 stores in its memory the proprietary call number supplied in advance from ROM 6 under the control of CPU 7. The decoder 3 compares the signal from the receiving circuit 2 with the proprietary call number, and recognizes an incoming call only when both the numbers are the same.

When the decoder 3 recognizes an end of a message signal, it interrupts operation of CPU 7 which in turn operates to transfer the message data to RAM 5.

After storing the message in RAM 5, CPU 7 sends signal to the decoder 3. In response to this signal, the decoder 3 causes one or any desired combination of the loudspeaker 12, LED 13, and motor 14 to perform the signalling operation. CPU 7 causes the LCD driver 8 to automatically display the received message on LCD 9. In reading a stored message, the switch 4 for example is activated.

Figure 2:
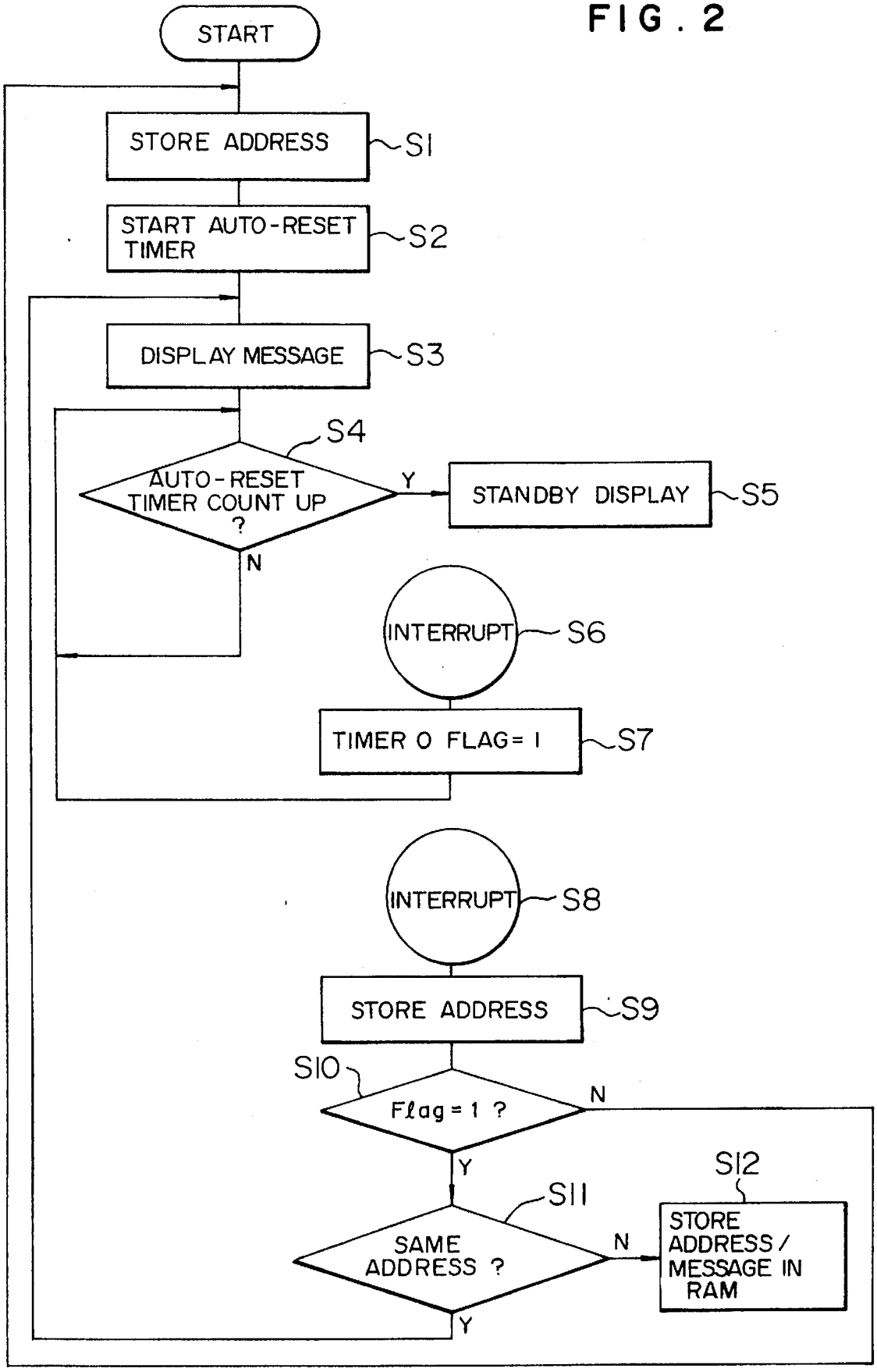
FIG. 2 is a flow chart showing the operation of the selective call receiver, under the control of a CPU, according to the embodiment shown in FIG. 1.

FIG. 2 is a flow chart showing the operation of the selective call receiver of this embodiment under the control of CPU 7. The operation of the selective call receiver will be described with reference to this flow chart. In information services, each selective call receiver is generally assigned a plurality of proprietary call numbers. Each call number has a function bit so that the receiver can have a number of information service addresses.

In reading out a message, first an address assigned to the message is stored (step S1). Then, an automatic reset timer (not shown) is reset and started (step S2). And the desired message is displayed (step S3).

In the normal mode (i.e., an automatic-reset mode), it is checked if the timer has counted up (step S4) to a present finite value. If it has not counted up, the pages enters a standby state (step S5) and the message is continues to be displayed until the timer counts up to the preset value and generates a "time-out" signal. For a particular mode (i.e., a non-automatic-reset mode) of this embodiment, the predetermined operation of switch 4 is activated to issue an interrupt from the decoder 3 (step S6). Upon this interrupt, the timer is cleared and a timer flag is set to "1" (step S7). With this process, the timer has no count value at which it will time-out; in other words, it will not count up (i.e., it will never generate a "time-out" signal) and the display on the LCD 9 is not auto-reset, unlike the above-described automatic-reset mode wherein the display on LCD 9 is auto-reset when the preset value is counted up.

The decoder 3 detects the preamble of a received data to check synchronization and an incoming call number. If the incoming call number is the same as the proprietary call number, the decoder 3 interrupts CPU 7 (step S8). Upon this interrupt, CPU 7 picks up the incoming address which is defined by the call number and its function bit (step S9) and stores it in RAM 5 as the latest address. It is checked if the timer flag is "1" (step S10). If "1", the initially stored address is compared with the newly received address (step S11).

If both the addresses are the same, the control returns to step S3 to display the new message. If they are different at step S11, the signalling operation by means of buzzer sounds or the like and the display operation are not carried out, but the received address and message are stored in RAM 5 (step S12). If the flag is "0" at step S10, the control returns to step S1.

According to the above-described embodiment, if a user activates the switch in the predetermined simple manner, the selective call receiver can display only those messages directed to a particular address. Accordingly, even if a plurality of messages are continuously or frequently transmitted by information services, only desired messages can be sequentially displayed and the latest message directed to a particular address can be monitored at all times. In this case, messages directed to different addresses are stored in the memory without performing the signalling operation and display operation.

According to the present invention, the predetermined simple manipulation of the switch allows the message directed to a particular address to be displayed continuously until a new message directed to the same address is received while a plurality of messages are continuously or frequently transmitted by information services. Messages directed to different addresses are stored in the memory without performing the signalling operation and display operation. Accordingly, a user can monitor only desired messages without being interrupted by such signalling operation. The messages stored in the memory can be displayed at any time when it becomes necessary.

I claim:

1. A selective call receiver comprising:

receiving means for receiving call data transmitted from an internal source and containing an address and message data;

signalling means for signalling that said message data has been received;

storage means for storing said message data received by said receiving means in a memory location designated by said address;

display means for displaying message data stored in said storage means;

comparing means for comparing an address of message data currently being displayed on said display means and an address of call data newly received by said receiving means;

switch means for performing a predetermined switch operation;

timer means for being set, in accordance with said predetermined switching operation, in either an automatic reset mode in which said timer means will generate a time-out signal when a predetermined count value is counted up or a non-automatic-reset mode in which said timer means has no count value at which it will generate a time-out signal; and processing means for controlling said storage means and said display means such that: (i) when said timer means is in said automatic reset mode and said comparing means judges that the address of said newly received call data does not coincide with the address of the message data currently being displayed, said processing means controls said display means to continue displaying said message currently being displayed and controls said storage means to store message data contained in said newly received call data in a memory location designated by the address contained in said newly received call data, (ii) when said timer means is in said non-automatic-reset mode and said comparing means judges that the address of said newly received call data coincides with the address of the message data currently being displayed on said display means, said processing means controls said display means to immediately replace said message data currently being displayed on said display means with message data of said newly received call data and when said timer means is in said non-automatic-reset mode and said comparing means judges that the address of said newly received call data does not coincide with the address of the message data currently being displayed, said processing means controls said display means to continue displaying the message currently being displayed and controls the storage means to store message data contained in said newly received call data in a memory location designated by the address contained in said newly received call data, and (iii) when message data of newly received call data is already stored in said storage means when said timer means is switched from said non-automatic-reset mode to said automatic-reset mode, said processing means controls said display means to replace a message currently being displayed on said display means with message data of said newly received call data.

2. A selective call receiver according to claim 1, wherein said address includes a call number of the selective call receiver and a function designating number.

3. A selective call receiver according to claim 1, wherein said storage means comprises a RAM circuit.

4. A selective call receiver according to claim 1, wherein said signalling means comprises at least one of (i) a loudspeaker, (ii) an LED, and (iii) a vibrational motor.

5. A selective call receiver according to claim 1, wherein said display means comprises an LCD driver, operatively associated with said processing means, and an LCD connected to said LCD driver.

6. A selective call receiver according to claim 2, wherein said signalling means comprises at least one of (i) a loudspeaker, (ii) an LED, and (iii) a vibrational motor.

7. A selective call receiver according to claim 3, wherein said signalling means comprises at least one of (i) a loudspeaker, (ii) an LED, and (iii) a vibrational motor.

8. A selective call receiver according to claim 2, wherein said display means comprises an LCD driver, operatively associated with said processing means, and an LCD connected to said LCD driver.

9. A selective call receiver according to claim 3, wherein said display means comprises an LCD driver, operatively associated with said processing means, and an LCD connected to said LCD driver.

10. A selective call receiver according to claim 4, wherein said display means comprises an LCD driver, operatively associated with said processing means, and an LCD connected to said LCD driver.

11. A selective call receiver according to claim 1, wherein said processing means, responsive to said timer means generating said time-out signal in said automatic reset mode, controls said display means to replace a message currently being displayed on said display means to replace a message currently being displayed on said display means with message data of newly received call data.

* * * * *